US010948259B2

(12) United States Patent
Keller

(10) Patent No.: US 10,948,259 B2
(45) Date of Patent: Mar. 16, 2021

(54) ARCHERY DEVICE

(71) Applicant: Paul F. Keller, Waterloo, WI (US)

(72) Inventor: Paul F. Keller, Waterloo, WI (US)

( * ) Notice: Subject to any disclaimer, the term of this patent is extended or adjusted under 35 U.S.C. 154(b) by 0 days.

(21) Appl. No.: 16/790,281

(22) Filed: Feb. 13, 2020

(65) Prior Publication Data

US 2020/0256633 A1 Aug. 13, 2020

Related U.S. Application Data

(60) Provisional application No. 62/805,028, filed on Feb. 13, 2019.

(51) Int. Cl.
*F41B 5/14* (2006.01)
*F41B 5/06* (2006.01)

(52) U.S. Cl.
CPC ..... *F41B 5/1426* (2013.01); *F41B 5/066* (2013.01); *F41B 5/1453* (2013.01); *F41B 5/1492* (2013.01); *F41B 5/1496* (2013.01)

(58) Field of Classification Search
CPC ..... F41B 5/066; F41B 5/1492; F41B 5/1453; F41B 5/1496
See application file for complete search history.

(56) References Cited

U.S. PATENT DOCUMENTS 1,276,463 A * 8/1918 Wells ..... F41B 5/1496 248/222.14
3,179,102 A * 4/1965 Peckham ..... F41B 5/1496 124/23.1
4,156,496 A 5/1979 Stinson
4,247,027 A 1/1981 Tardiff
4,635,611 A 1/1987 Priebe
4,788,961 A 12/1988 Toth
4,817,579 A * 4/1989 Mathias ..... F41B 5/1496 124/23.1
4,974,575 A * 12/1990 Mitchell ..... F41B 5/1496 124/23.1
4,995,372 A 2/1991 Topel
5,190,022 A 3/1993 Larson
5,488,941 A 2/1996 Springstead
5,566,665 A 10/1996 Stinson
5,775,313 A 7/1998 Bresette et al.
5,803,069 A 9/1998 Schreiber
5,944,041 A * 8/1999 Kitchens ..... E04H 15/001 124/23.1
6,006,734 A 12/1999 Sodaro
6,050,252 A 4/2000 Etheridge
6,179,514 B1 * 1/2001 Cheng ..... B25G 3/10 285/308
6,390,085 B1 5/2002 Stinson
(Continued)

*Primary Examiner* — John A Ricci
(74) *Attorney, Agent, or Firm* — Smith Keane LLP

(57) ABSTRACT

Systems and methods directed to archery bow accessories include a panel to be mounted on an archery bow, forward of the archery bow limbs, to provide stabilization, silencing, and/or concealment. The panel may be sufficiently rigid to support all or some of the weight of the archery bow against a support structure, such as the ground. The panel may also be sufficiently structurally sound to quiver arrows and to support other optional features, such as aiming devices. Silencing functionality of the panel may be enhanced by usage of or addition of sound absorbing materials, such as cork, foam, rubber, honeycomb structures, or combinations thereof.

14 Claims, 10 Drawing Sheets

(56) References Cited

U.S. PATENT DOCUMENTS

| | | | | |
|---|---|---|---|---|
| 6,431,192 | B2 * | 8/2002 | O'Hare | A01M 31/025 135/125 |
| 6,672,299 | B2 | 1/2004 | Proctor | |
| 6,845,765 | B1 | 1/2005 | Allshouse et al. | |
| 7,216,644 | B2 * | 5/2007 | Haugen | F41B 5/1496 124/86 |
| 7,275,532 | B2 * | 10/2007 | Niemackl | F41B 5/14 124/23.1 |
| 7,770,573 | B2 * | 8/2010 | Haugen | A01M 31/025 124/86 |
| 7,958,878 | B2 * | 6/2011 | Hoffmann | F41H 3/02 124/25 |
| 8,122,874 | B2 | 2/2012 | LoRocco | |
| 8,720,428 | B2 * | 5/2014 | Jantzen | F41H 3/02 124/86 |
| 8,839,772 | B2 | 9/2014 | Lee | |
| 8,839,773 | B2 | 9/2014 | Ellig | |
| 8,869,783 | B2 * | 10/2014 | Faherty | F41B 5/1496 124/86 |
| 9,766,031 | B2 | 9/2017 | Evans | |
| 10,203,186 | B2 | 2/2019 | Yehle et al. | |
| 2002/0162547 | A1 | 11/2002 | McMillan, III | |
| 2004/0178550 | A1 | 9/2004 | Donovan | |
| 2005/0150484 | A1 | 7/2005 | Horn | |
| 2014/0267721 | A1 | 9/2014 | Stern et al. | |
| 2014/0352679 | A1 | 12/2014 | Torbett | |
| 2016/0061556 | A1 | 3/2016 | Armstrong et al. | |
| 2017/0347643 | A1 * | 12/2017 | Sheedfar | A01M 31/025 |
| 2019/0056197 | A1 | 2/2019 | Matthews | |
| 2019/0137212 | A1 | 5/2019 | Yehle | |
| 2019/0170472 | A1 | 6/2019 | Houle | |
| 2019/0234702 | A1 | 8/2019 | Kelly | |
| 2020/0003519 | A1 | 1/2020 | Jonas, IV | |

* cited by examiner

ARCHERY DEVICE

RELATED APPLICATIONS

This application claims the benefit of U.S. Provisional Patent Application Ser. No. 62/805,028, filed 13 Feb. 2019, and entitled "Concealing Quiver," which is incorporated herein by reference in its entirety.

BACKGROUND OF THE INVENTION

The present invention relates generally to accessories to be used by archers, and more specifically to a bow mounted or supporting panel. Archery has evolved over time from simple stick bows and arrows to include numerous complex accessory devices. The first bows were carved from wood, and their light weight was convenient for transport. At some point in time an archer realized that the bow could be held steadier and accuracy could be improved by adding weight to the bow. Bows have been carrying extra stabilizing weight ever since. Today's shooting stabilizers are placed forward of the bow to minimize the mass required to perform the function. United States patent application publication 2020/0003519 to Jonas, IV reveals such a device. A multi-function archery device which places its mass forward of the bow to stabilize shooting while performing additional archery functions might be preferred by today's archers.

The release of stored energy required to propel an arrow from a bow creates vibration of bow components. A sound wave results which may cause game animals to jump or dodge an arrow. Many devices which reduce noise and vibrations have been offered to archers to reduce this problem as seen in U.S. patent application publications (e.g., 2019/0234702, 2004/0178550 and 2002/0162547). A device which more effectively absorbs, diffuses, and/or deflects vibration, and intercepts its resulting sound wave to reduce poor hits on game animals would be preferred over the current art by today's archers.

The arrow quiver likely came into existence shortly after man discovered the benefits of propelling sticks from a string powered by compressed limbs. At that time, bows were inaccurate devices, and propelling more than one arrow at game or an enemy was common. Because the act of shooting a bow requires two hands, a bag or pouch was likely used and eventually carried on the archer's back or hip to carry a supply of arrows. This device came to be known as a quiver.

Attaching a quiver directly to an archer's bow is a much more recent development, due to improvements in modern bow accuracy which reduce an archer's need to carry more than a few arrows at a time. Most modern quivers are designed to be attached to the side of a bow for convenient transport. This attachment creates an imbalance in the bow while shooting. Many archers add a weighted stabilizer to the front and/or side of their bow to offset this effect as seen in U.S. patent application publication 2016/0061556. Today's bow quivers are designed to be quickly removed from the side of the bow to improve bow balance while shooting. Carrying the additional weight of a stabilizer, and accessing arrows from a removed quiver in a hunting setting are inconveniences to hunting archers. A quiver designed as a stabilizer to allow rapid access to arrows as shown in U.S. patent application publication 2019/0170472 may be impractical to use in close quarters or dense cover. A multi-function archery device performing quiver duties while improving bow balance and shooting stabilization may be preferred over the current art by today's archers.

Stalking game and drawing a bow's string require movement which may spook game animals. Archers have attached natural and man-made materials to themselves and their bows to help conceal these movements for eons. United States patent application publication 2017/0347643 depicts a device which helps archers hide from game. A device with a changeable concealing surface which also performs additional functions may be preferred over the current art.

The need to prop a bow upright in the vertical position is revealed to archers while target shooting, and while stalking or waiting for game animals while hunting from the ground. United States patent application publication 2005/0150484 details a device which performs this function. In addition, there are times when an archer may desire to prop a bow in face-down or side-ways orientations. A multifunction archery device may perform these tasks and be preferred over the current art by today's archers.

The incorporation of a lighted arrow nock as seen in U.S. Pat. No. 10,203,186 allows a video device as seen in U.S. patent application publication 2014/0267721 to record an arrow's flight and impact location as well as other details of a hunting experience. Even with video stabilization technology, video quality tends to be poor from such devices due to their direct, near-rigid attachment to a bow. Bow vibrations upon arrow release are transmitted to the recorded video, providing shaky footage. A vibration-absorbing multi-function archery device would allow a cell phone camera or other commonly available micro video camera to record the arrow's journey with better video quality, at lower cost, and would be preferred over the current art.

Most modern archers use an aiming device or sight attached to their bow to improve shooting accuracy. These devices are attached directly to a side of a bow and add to the bow's weight imbalance. United States patent application publication 2019/0056197 depicts a lighted bubble device intended to improve shooting accuracy. An optionally lighted sighting device may be incorporated into a multi-functional archery device to improve a bow's balance and accuracy, and be preferred over the current art by today's archers.

An archer may improve shooting accuracy by using a shooting stick device as seen in U.S. patent application publication 2014/0352679. A similar device might be incorporated into a multi-function archery device and be preferred over the current art by today's archers.

Even a silent quiver might need to be removed from a bow on a windy day to improve accuracy. A multi-function archery device which may be suspended to improve access to arrows might be preferred over the current art.

Today's archers commonly purchase archery accessories separately based upon their function, including shooting stabilizers, noise suppression devices, arrow quivers, bow balancers, concealing surfaces, support stands, video cameras, sighting devices and shooting sticks. The combined cost and weight of these components are an impediment to archery activities. The need for combination, simplification, and improved performance from these devices is revealed through examination and experience.

SUMMARY OF THE INVENTION

An archery device is revealed which might be fixedly, axially, or removably attached to an archer's longbow, recurve bow, compound bow, or crossbow to act as a weight-forward shooting stabilizer. The device might be constructed and dimensioned to substantially intercept by deflecting, diffusing, and/or absorbing the sounds produced by a bow while discharging an arrow. In several embodiments the device may also act as a support stand to prop a bow in the upright and other positions. In several embodiments the device may also function as an arrow quiver, allowing concealed access to a plurality of arrows. It may additionally conceal an archer from game while stalking and shooting, and its surface(s) might be altered to match an archer's location. The device's mass might be offset from a vertical centerline to act as a bow balancer to improve accuracy. The device may incorporate an optionally lighted aiming device which might include a level position indicator. The device may host a video recording device to record the arrow's travel and impact location. A shooting stick might be included in the device's construction to improve shooting accuracy. A feature of the device may allow the device to be suspended from a hook or branch as commonly used by archers in a tree stand. Many combinations of these functions may be performed by a single, lightweight, and efficient archery device, attachable to an archer's bow.

An archery device according to the present invention preferably provides multiple functions. Such device is generally constructed as a planar (or curviplanar) panel with a body dimensioned in height, width, thickness, and mass, said body having primarily planar opposite forward and rearward surfaces, opposite upper and lower surfaces, and two opposite side surfaces. A mounting interface provides means for attachment of said body to a vertical-type bow, allowing an archer convenient transport afield.

An archery device according to the present invention preferably provides shooting stabilization functionality, silencing functionality and/or visual concealment. Shooting stabilization may be provided by way of connecting the device to an archery bow such that the center of mass of the device is outside (preferably forward) a perimeter of the device, or at least forward of a grip provided on the archery bow riser. Further stabilization may be provided with additional structure configured to interface a support surface. For instance, at least one vertically or horizontally adjustable shooting stick may be supported by the panel or used in combination therewith.

Silencing may be provided by constructing the device with sufficient height, width and thickness with absorptive, and/or diffusive, and/or deflective materials to substantially intercept bow vibrations and the forward-travelling sound waves created upon launching an arrow from the bow, where the device is positioned between said bow (or bowstring) and a target or game animal. Visual concealment may be provided when the device is placed between a user of the archery bow (i.e., archer) and a target (e.g., animal) to visually block or impair the target's ability to detect the archer, while providing at least one sighting/shooting port sized and located to allow the archer vision through said port while aiming, and functionally unobstructed travel of arrows during shooting.

A device according to the present invention may also include a means to prop or partially support an archery bow in a desired orientation (e.g., approximately vertical and/or horizontal directions) via contact points or planar contact on an approximately horizontal surface via connection to said bow with said mounting interface, and sufficient strength, rigidity, and dimension of said construction materials to support said bow in said approximately vertical and/or horizontal planes.

A device according to the present invention may further provide quiver functionality to maintain arrows in a preferred orientation relative to bow limbs. For instance, arrows may be quivered in a longitudinal direction that is substantially parallel to a bow string that is in an at-rest position. A quiver structure preferably includes a hood or cap to receive an end of an arrow (e.g., nock or point) and a gripping or holding structure, such as a passive or active clip to releasably engage the arrow body.

A device according to the present invention may further serve to equalize a mass imbalance of an archery bow and its attached accessories from a vertical or horizontal axis of the bow, by supporting asymmetrical mass distribution from the median plane of said body.

A device according to the present invention may further include sighting or positioning aids, such as an archery pin sight, which may be lighted, and/or one or more bubble leveling devices. The sighting or positioning aids are preferably positioned in a location that can be seen by an archer during the draw and aiming of the bow, such as on the rearward surface of the device or near or in a shooting portal provided through the device.

A device according to the present invention may further include a means to record photographs, video, and/or sound via fixed or removable attachment of at least one recording device (such as a smart phone or micro-camera) to the archery device.

A device according to the present invention may include a means to suspend said multi-function archery device from a man-made support or tree projection (e.g., tree limb or partial tree limb) by way of a support loop and/or hook at or near an edge of the panel (e.g., the upper and/or lower terminus of said body).

A panel according to the present invention may be provided as a relatively rigid solid panel, made from such materials as wood, plywood, carbon fiber sheeting, fiberglass, plastic, etc., or combinations thereof (and further optionally including sound insulation, such as foam, honeycomb panel structures, cork, or combinations thereof. Alternatively, the panel may be provided as a frame having a relatively rigid perimeter and/or cross-brace(s) surrounding or extending through an open truss area that may be covered with a lightweight concealing material, such as a textile fabric featuring camouflage decoration, or a mesh/netting layer capable of hosting natural vegetation or man-made camouflage material. Such panel including a frame with fabric covering a truss arrangement is thought to provide a reduced silencing functionality (i.e., is not as effective at silencing bowstring noise as a solid panel), but the frame structure is still sufficient to provide other stabilization and quiver functionality. In any event, a preferred panel according to the present invention preferably includes sufficient rigid structure to at least partially support an archery bow in desired orientations.

According to an aspect of an archery device according to an embodiment of the present invention, such device may include a panel having a substantially planar forward surface and opposed substantially planar rearward surface, with a projectile portal formed through the panel. The panel may be formed from (or may include a frame composed of) wood, carbon fiber, plastic, or fiberglass, or consist essentially of such selected material. A substantially rigid mounting interface (e.g., at least one bracket) configured to support the panel on an archery bow riser. A preferred mounting interface includes a first mounting bracket secured to the rearward panel surface and a second mounting bracket configured to be secured to the archery bow riser, wherein the first mounting bracket and the second mounting bracket are matingly engageable, such as through the use of a longitudinal projection and a mating receiving slot. The first mounting bracket may include the receiving slot and the second mounting bracket may include the longitudinal projection. The second mounting bracket may also be formed from a Z-brace in combination with an F-brace. Such Z-brace may include a mounting beam extending from a first free end to a first beam intersection, a medial beam extending from the first beam intersection to a second beam intersection, and a lateral beam extending from the second beam intersection to a second free end. An F-brace may include the longitudinal projection and two mounting legs extending at least substantially perpendicular to the longitudinal projection and secured to the medial beam of the Z-brace. The receiving slot on the first mounting bracket may be mateable separately with each of the longitudinal projection and the lateral beam. Alternatively, the second bracket may be formed from an L-brace to provide the forward extending longitudinal projection, or a T-brace to provide both the forward projection and the lateral beam.

According to another aspect of an embodiment of an archery device according to the present invention, a quiver structure may be secured to the rearward surface of the panel. The quiver structure preferably includes at least one tip hood aligned with a clip.

According to still another aspect of an embodiment of an archery device according to the present invention, an aiming device may overlap or extend into or in line with the projectile portal. The aiming device may be a crosshair sight, a fiber optic pin sight, a multiple pin sight, a laser sight, an adjustable sight, or a telescopic sight.

According to yet another aspect of an embodiment of an archery device according to the present invention, a camera port may be formed through the panel, and a camera support bracket may be configured to support an image capture device to enable capturing of images through the camera port.

According to a further aspect of an embodiment of an archery device according to the present invention, the device may include an extendable resting mechanism configured to longitudinally translate from a stored position to an activated position. The resting mechanism may include at least one shooting stick longitudinally translatable in a direction that is at least substantially parallel to the rearward surface. A lever may be provided, the activation of which causes the shooting stick to translate from the stored position to the activated position, the lever being spring biased in a direction to frictionally engage the shooting stick, thereby substantially impeding longitudinal translation of the shooting stick. Translation of the shooting stick may be caused by manual force applied to the stick, automatic biasing force, or gravity.

According to a still further aspect of an embodiment of an archery device according to the present invention, a textile fabric (e.g., camouflage fabric) may covering a majority of at least the forward surface of the panel.

According to an aspect of an embodiment of a method according to the present invention, the method includes the step of rigidly securing a panel to an archery bow, the panel comprising a first opening therethrough. The method also includes the step of nocking an arrow on a string of the archery bow, the nocked arrow extending through the opening. The method also includes the step of releasing a string of the bow to propel the arrow entirely through the opening in an aiming direction. The method may further include the step of removing the arrow from a quiver supported by the panel prior to the nocking step.

According to another aspect of an embodiment of a method according to the present invention, the method may include the step of, circumferentially about the first opening, deflecting a majority of sound waves caused by the releasing step to impede travel of the majority of sound waves in the aiming direction.

According to an aspect of an embodiment of a kit according to the present invention, the kit may include a first mounting bracket including a longitudinal projection (preferably configured to be secured to an archery bow riser), a second mounting bracket including a receiving slot (configured to be secured to a panel) configured to receive the longitudinal projection, and a set screw configured to frictionally secure the longitudinal projection in the receiving slot. The first mounting bracket, second mounting bracket, and the set screw may all be disposed in the same container (e.g., bag, box, clamshell) and may be associated with or coupled to a panel according to the present invention, or packaging thereof.

DESCRIPTION OF THE PREFERRED EMBODIMENT

Although the disclosure hereof is detailed and exact to enable those skilled in the art to practice the invention, the physical embodiments herein disclosed merely exemplify the invention which may be embodied in other specific structures. While the preferred embodiment has been described, the details may be changed without departing from the invention, which is defined by the claims.

Preliminarily related to terminology, on an archery bow, the bow string (the string that is activated to propel a projectile such as an arrow) may be considered to be towards a rear side of a bow. The portions of the bow opposite the string (e.g., the riser and limbs) comprise a front side of a bow. Two alternate sides of a bow exist in planes parallel to the plane formed by a bowstring and a medial portion of the riser. A bow may be considered to be in a vertical plane or arrangement when the bowstring is at least substantially perpendicular to the earth's surface (e.g., at least substantially in the direction of gravity). A bow may be considered to be in a horizontal plane or arrangement when the plane between the bowstring and medial portion of the riser is at least substantially parallel to the earth's surface (e.g, at least substantially perpendicular to the direction of gravity).

Figure 1:
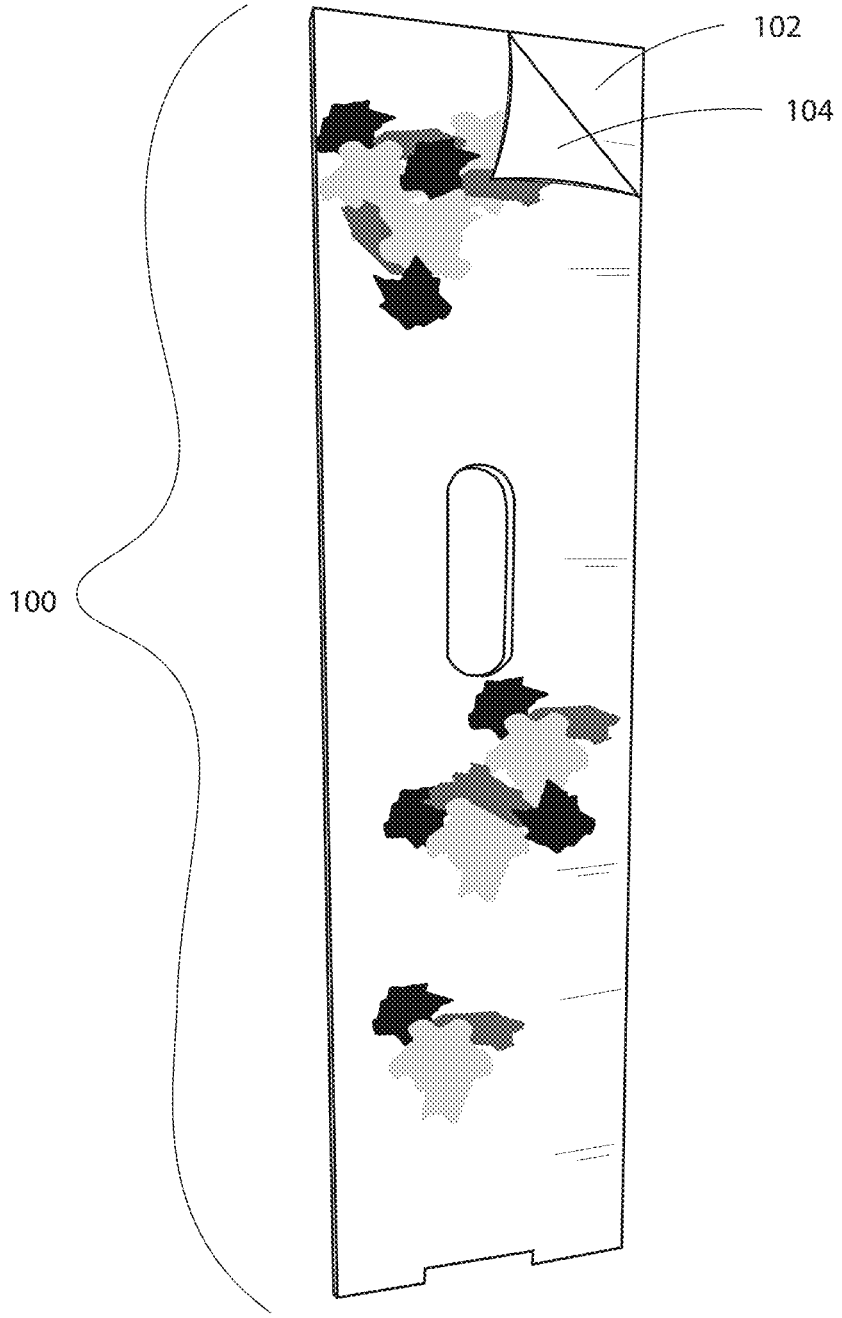
FIG. 1 is a front left perspective view of a first embodiment according to the present invention.
Figure 2:
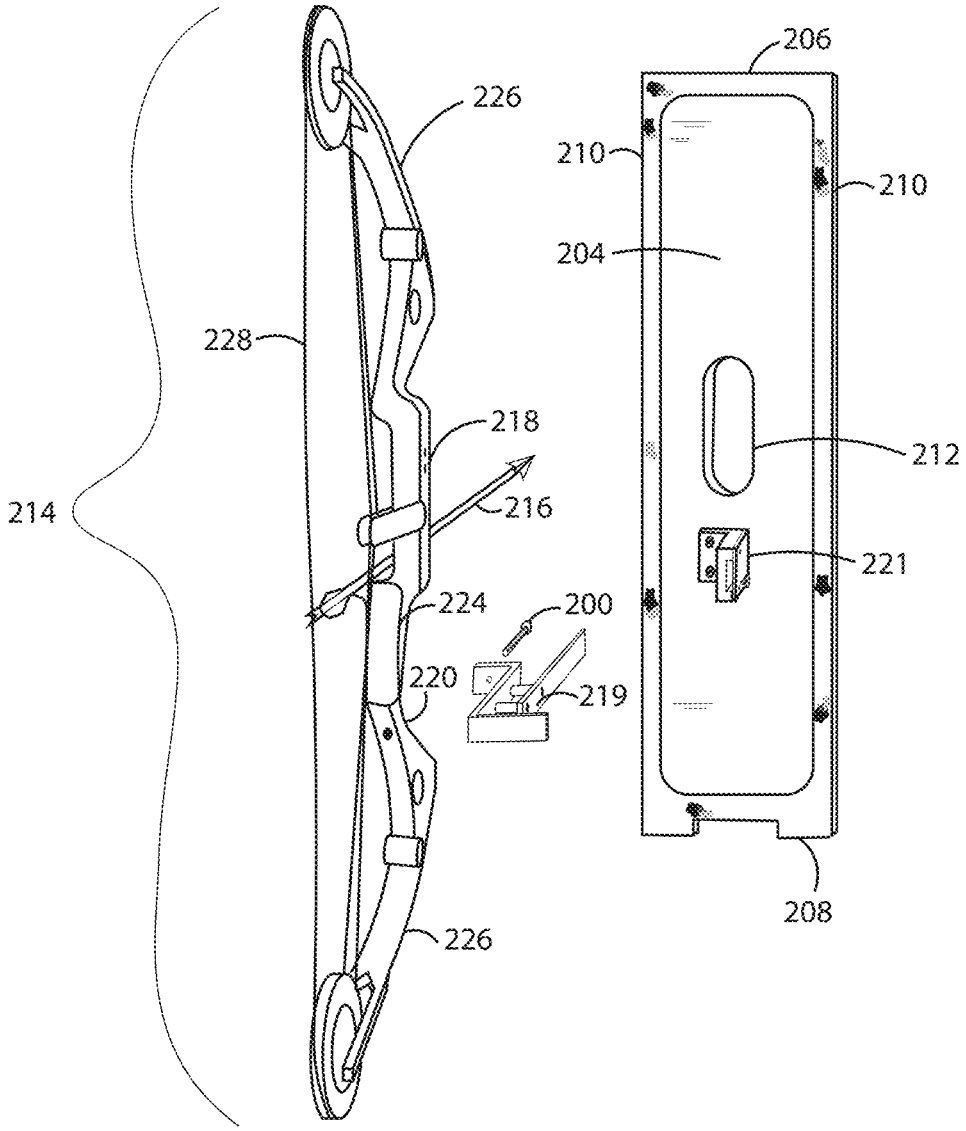
FIG. 2 is a rear right perspective partial assembly view of the embodiment of FIG. 1 in combination with an archery bow.

An embodiment of an archery device is depicted in FIG. 1 and FIG. 2. This embodiment may be intended for use with a vertical-type (e.g., long, recurve, or compound) bow. The body 100 of the embodiment is dimensioned in height, width, and thickness to serve several functions which improve bow and arrow shooting and hunting outcomes for archers. The body 100 of the embodiment may generally be formed as a panel having at least substantially parallel forward 102 and rearward 204 flat planar surfaces, as well as an upper 206 surface and a lower 208 surface, and two opposite sides 210. Alternatively, the panel may be provided as a curviplanar panel, which may generally follow (though preferably spaced from) the curve of the bow riser (e.g., 315) and/or limbs (e.g., 226). A sighting/shooting port 212 (or projectile portal) in the body 100 of the embodiment allows for aiming of a bow 214 and unobstructed arrow 216 travel.

Figure 7:
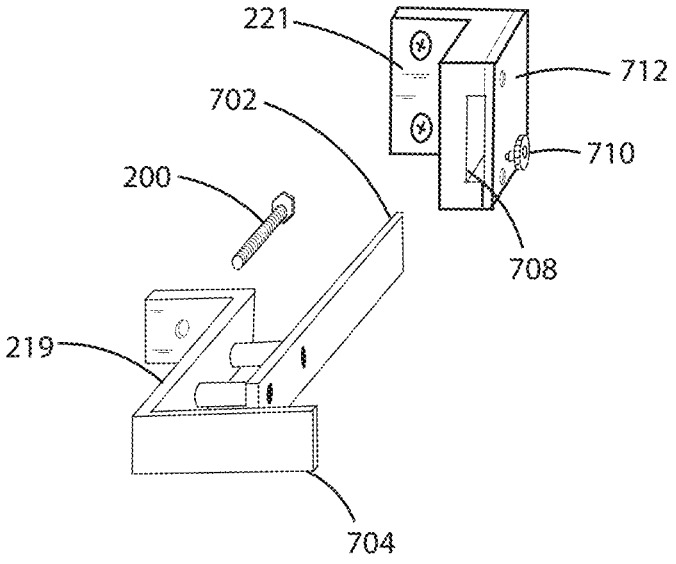
FIG. 7 is a partial assembly view of an embodiment of a first mounting interface according to the present invention.
Figure 8A:
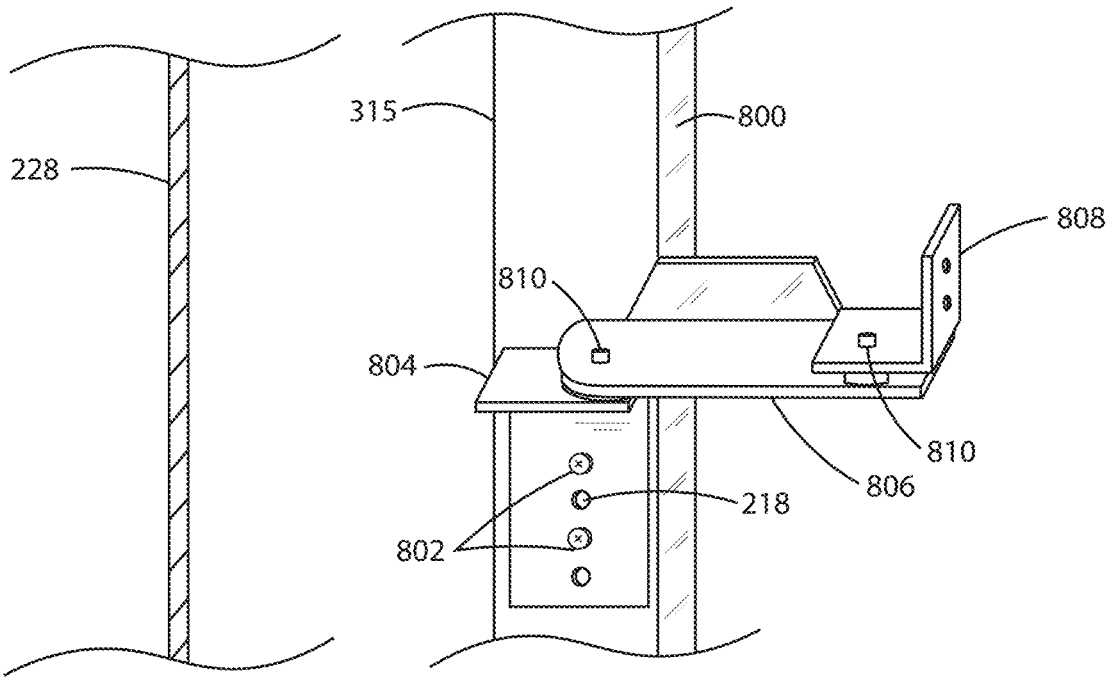
FIG. 8A is a front right perspective view of an axial mounting interface according to the present invention in a first position.
Figure 8B:
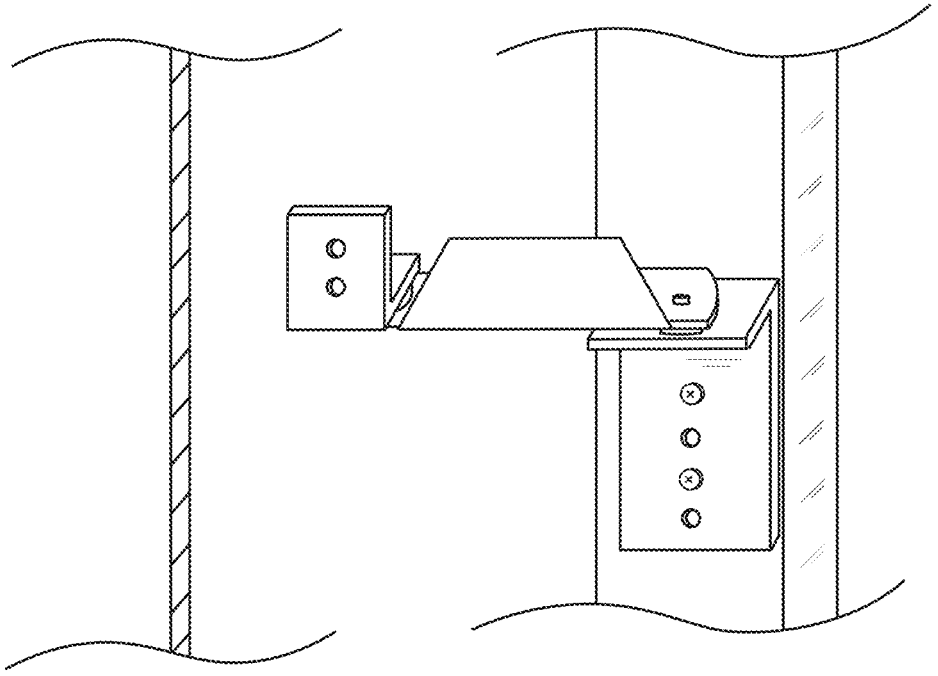
FIG. 8B is a front right perspective view of the axial mounting interface of FIG. 8A in a second position.

Referring to FIG. 2 and FIG. 7, a mounting interface of two parts 219, 221, allows connection of the embodiment to a (compound) bow 214. This mounting interface, seen in isolation in FIG. 7-10, allows the embodiment to be adjustably located forward of a bow 214, in the operational position, and relocation to a side of a bow 214, to the stored position. A threaded bolt 200 connects a bracket 219 (e.g., a Z-bracket secured to an F-bracket) with a forward projection 702 and a side projection 704 to a bow 214. A mated bracket 221 on the rearward surface 204 of the embodiment receives the forward projection 702, or alternately side projection 704, in a slot 708. A tightening knob 710 may be turned to squeeze a pressure plate 712 onto the forward projection 702, or alternately side projection 704, to provide a rigid attachment between the bow 214 and the embodiment. An arrow 216 may be shot from a bow 214 with the embodiment in the operational or stored positions.

Figure 3:
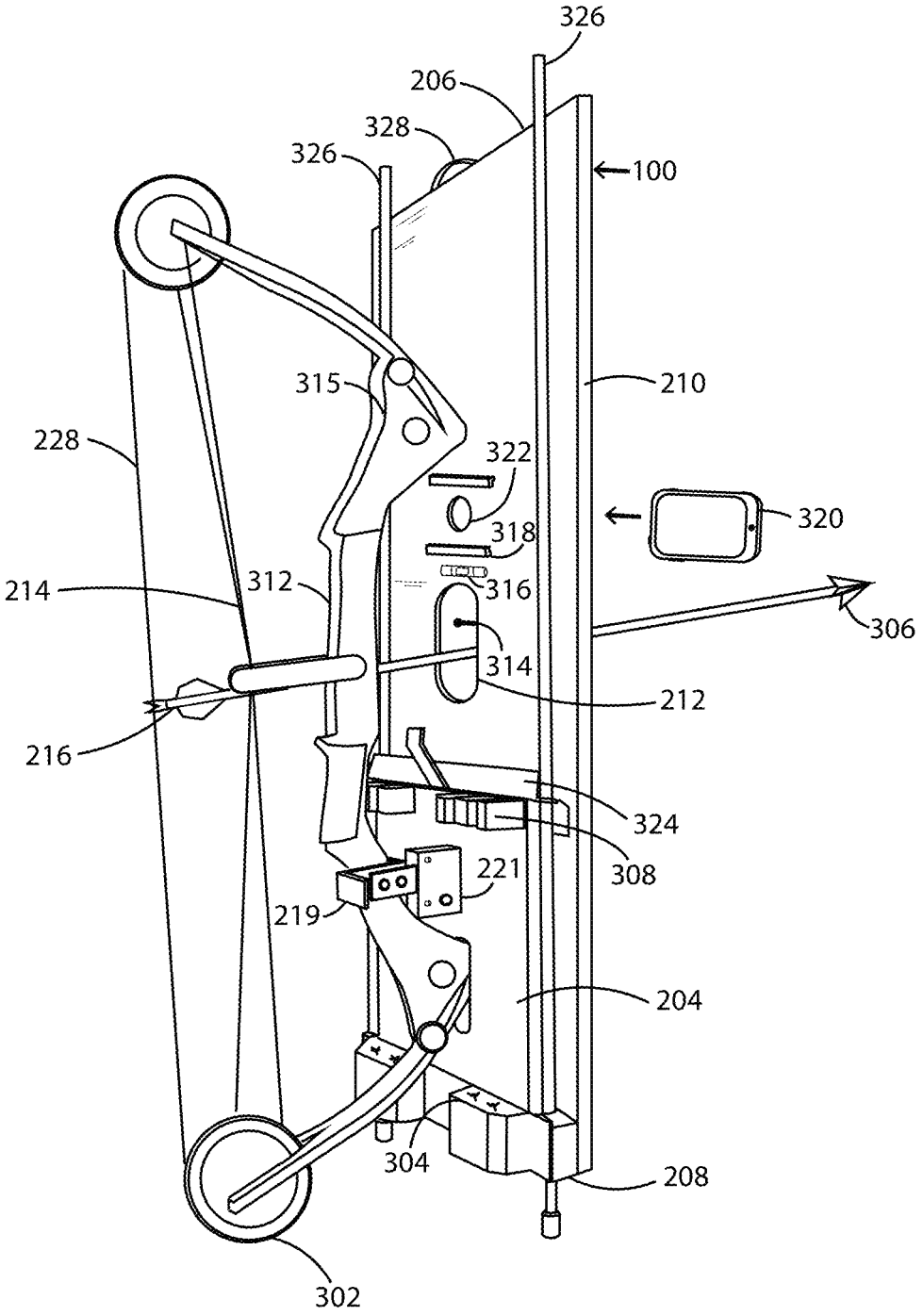
FIG. 3 is a rear right perspective view of a second embodiment according to the present invention in combination with an archery bow.
Figure 4:
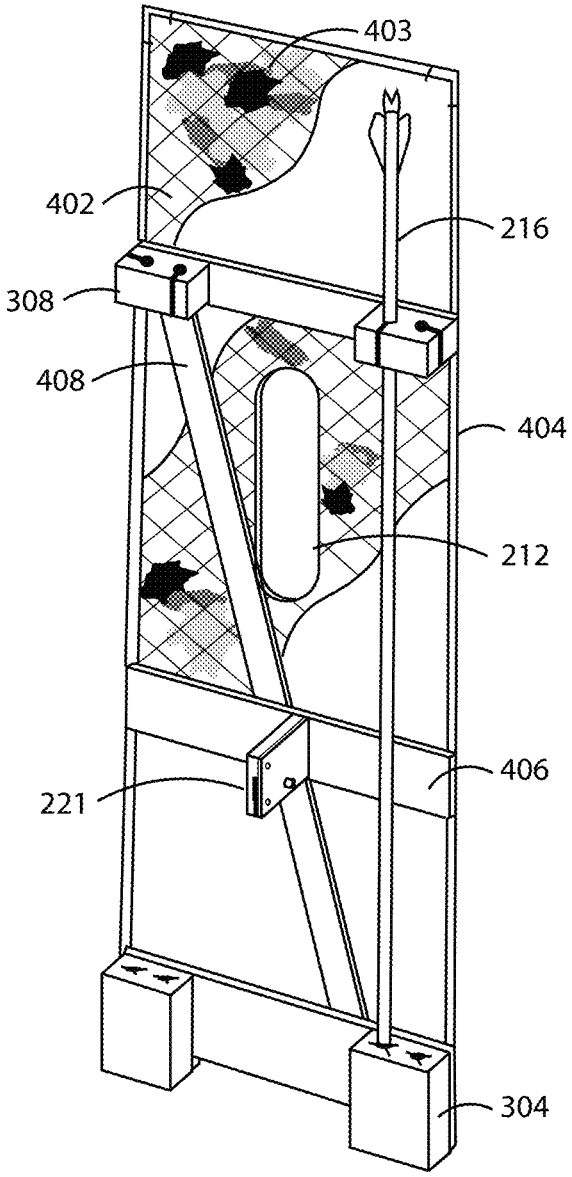
FIG. 4 is a rear right perspective view of a third embodiment according to the present invention.

Archers who compete in shooting tournaments and most bow hunters use a weight-forward shooting stabilizer to steady their bow while aiming and shooting. Referring also to FIG. 3 and FIG. 4, attachment of the embodiment forward of a bow's handle 224 places the device's mass in a forward stabilizing position, eliminating the need for a separate weighted shooting stabilizer. A mounting interface which allows an embodiment to be adjustably located forward of a bow 214 as in FIGS. 2-10, 3-10, 4-10, and 7-10 allows an archer to tune the stabilizing function to match the archer's shooting style.

Returning to FIG. 1 and FIG. 2, the release of stored energy and forward motion of a bow's limbs 226 and string 228 during arrow 216 release create sound waves which travel toward an archer's target at the speed of sound, approximately 1125 feet per second. Because an arrow 216 travels much slower, 150-400 feet per second, an alert game animal will often hear the sound of the bow 214 and move to escape before the arrow 216 reaches its intended impact location. Archers have long attempted to reduce bow vibrations and noises with dampers and limb and string silencers. The mass, dimension and construction material(s) of the body 100 of the embodiment, forward of a bow's moving components allows it to intercept forward traveling sound waves generated during the release of an arrow 216 from a bow 214, and reduces the likelihood of poor hits on game. A sound wave can be directionally reduced or blocked through absorptive and diffusive materials such as foam, honeycomb panel structures, cork, or combinations thereof, and/or redirected with deflective materials such as carbon fiber sheeting or hard plastic in a sound barrier. As these materials are lightweight, and as bow types typically perform at variable decibel levels, the material type and thickness of the body 100 may be chosen to achieve the desired sound reduction based upon the type of bow the embodiment is intended for. The rearward surface 204 of the body 100 may also be contoured or textured to further absorb, diffuse, or deflect sound waves. The sighting/shooting port 212 in the body 100 is generally as small as practical in width and height to maximize sound wave interception but substantial enough to allow an archer to clearly see an intended target or approaching game.

The body 100 of the embodiment may serve as a visual concealment device to hide an archer and the movements required to approach game, aim, and shoot an arrow 216. The forward planar surface 102 is in an ideal orientation to host a removable mirror or camouflage surface 104 and/or have a mirror or camouflage surface fixedly printed, molded, or shaped, etc. thereon during the construction process. The upper 206 and lower 208 surfaces, and opposite sides 210 of the body 100 might be similarly covered with the same or additional camouflage layers. A removable layering system offering a variety of camouflage patterns allows an archer to more closely match a hunting location. This removable surface 104 might be attached to the body 100 of the embodiment via latch and hook, snap button, string ties, elastic bands or other common attachment means.

Turning now to FIG. 3, a second embodiment according to the present invention may perform similar or identical functions of the first embodiment (shooting stabilization, silencing, and concealing), as well as additional functions for an archer.

The embodiment may prop a bow 214 in approximately vertical and/or horizontal orientations on a generally horizontal surface such as the earth or a table top. A three-point triangular base configuration is used for stable propping on uneven surfaces, with one point the bow's lower terminus 302. In this embodiment, propping of bows of varied dimension with the bow's string 228 in an approximately vertical plane is achieved by proper vertical location of the mounting interface on the rearward surface 204 of the body 100. The bow 214 may be propped horizontally on either of the two opposite sides 210 of the embodiment or with the embodiment's forward planar surface 102 on the earth or table top. The embodiment's construction material(s) must provide sufficient strength and rigidity to the body 100 of the embodiment to perform the propping functions without bending, twisting, or breaking the embodiment. The body 100 of the embodiment should be of sufficient width to prevent tipping of the embodiment and attached bow 214 when placed on uneven terrain and during normally encountered wind conditions.

The rearward surface 204 of the body 100 may host arrows 216 for convenient access. One or more protective arrow tip hood(s) 304 may be located at or near the upper surface 206 and/or lower surface 208 of the device to cover arrow tips 306. One or more arrow gripping/holding structure(s) 308 on the rearward surface 204 may releasably engage one or more arrow(s) 216. The body 100 of the embodiment serves to hide the hand movements required to remove an arrow 216 from the device and place it on the bow's string 228, as required during a second shot at a game animal.

Virtually all vertical type bows have an inherent mass imbalance from the median plane of the bow 214 because of the distortion in a bow's riser 315 from the sighting/shooting window 312 and/or the attachment of accessories to predominantly one side of the bow's riser 315. The embodiment may offset this imbalance by placing additional mass of extra arrows 216, or asymmetrical body width, or other added mass opposite the imbalance, thereby balancing the aggregate structure.

An embodiment may include an aiming device 314 built into or attached to the body 100 of the embodiment, near or in the shooting/sighting port 212 thereby eliminating the need for a separate bow sight. The extended sighting plane provided by the forward position of the embodiment provides the potential to greatly improve accuracy for an archer, while reducing the weight of the aggregate system. Any known sight type could be adapted for use in an embodiment, including crosshair, fiber optic pin, multiple pin, laser, adjustable, telescopic, etc.

Many modern aiming devices 314 have a bubble level device 316 incorporated into their design. The rearward surface 204 of an embodiment might host such a device. In embodiments for archers who shoot with a bow 214 in a canted position, a bubble level device 316 which can be installed by the archer might be canted during installation to ensure a consistent canting angle for these archers. For example, an adhesive backing on a bubble level device 316 would allow such a device to be attached by an archer.

A shelf bracket 318 or similar structure may be installed on the rearward surface 204 of the embodiment to hold a smart phone 320 with video and sound recording capabilities. A camera lens port 322 allows a camera lens on a smart phone 320 to capture action where the arrow 216 is directed before, during, and after a shot. A camera holding structure such as a shelf bracket 318 might be adjustable in tilt and pan directions to ensure proper orientation of the camera lens. The body 100 hides hand movements required to operate the camera such as zooming and focusing. A bracket typical to a sport camera (not shown) would allow that camera type to record arrow flight and other hunt details in a similar manner. A miniature camera (not shown) built-in to the camera lens port 322 might also perform the recording function.

Archers who stalk or hunt from the ground benefit greatly by using a vertically adjustable shooting stick device 324. This device allows an archer to hold a bow 214 in shooting position for lengthy periods of time while game approaches. Shooting accuracy is also much improved particularly during moments of extreme excitement as when shooting at game. The embodiment of FIG. 3-10 incorporates a spring-biased, finger-actuated (preferably by fingers of a hand holding the bow grip) shooting stick device of bipod design. Once actuated, two shooting sticks 326 are allowed to drop vertically until each of them contacts the ground or other support surface. The bipod design allows propping of a bow in an upright, substantially vertical plane in extremely uneven terrain, as the two shooting sticks 326 are independently adjustable. That is, on uneven terrain, one of the sticks 326 may vertically fall a first distance to contact the terrain, and the other of the sticks 326 may vertically fall a second distance to contact a different point on the terrain. The first and second distances may be identical or substantially the same, or they may be different such that the difference exceeds one-half of a longitudinal length of such stick(s) 326, or more. A shooting stick device 324 may be built into or attached to the body 100 of the embodiment or the embodiment portion of the mounting interface 221, as an optional accessory. The shooting stick(s) 326 can be quickly removed from the shooting stick device 324 if an archer wishes to hunt without such assistance.

Archers who hunt from an elevated location in very windy weather may desire to remove and store the embodiment. A weather-resistant suspension loop 328, hook, or similar structure on or near the upper 206 and/or lower 208 surface(s) allows an archer to suspend the embodiment from a tree branch or installed support.

Turning now to FIG. 4, a third embodiment of an archery device according to the present invention can be described. A third embodiment is attachable to an archer's bow with the same mounting interface options, and performs the weight-forward shooting stabilizing function in the same manner as the first and second embodiments. However, a fixed or removable layer of lightweight camouflage materials which do not substantially absorb, diffuse, and/or deflect bow noises such as fabrics, or a mesh/netting layer 402 capable of hosting natural vegetation or man-made camouflage material 403 form a primarily planar visual barrier to conceal an archer. This material is supported by a structure such as a frame, for example, of vertical 404 and horizontal 406 and/or angled 408 structural members. This structure has the strength and rigidity to support at least one protective arrow tip hood 304 and one or more arrow gripping/holding structure(s) (e.g., passive or active clips) 308 to form a quiver. The quiver holds one or more arrow(s) 216 in an organized manner. Sighting and arrow shooting occur through a sighting/shooting port 212 in the mesh/netting layer 402. Additional functions may be added to this embodiment to form additional embodiments to provide options for an archer as described in the second embodiment of FIG. 3-10 including propping, balancing, sighting, leveling, recording, additional shooting stabilization via a shooting stick device, and suspension.

Figure 5:
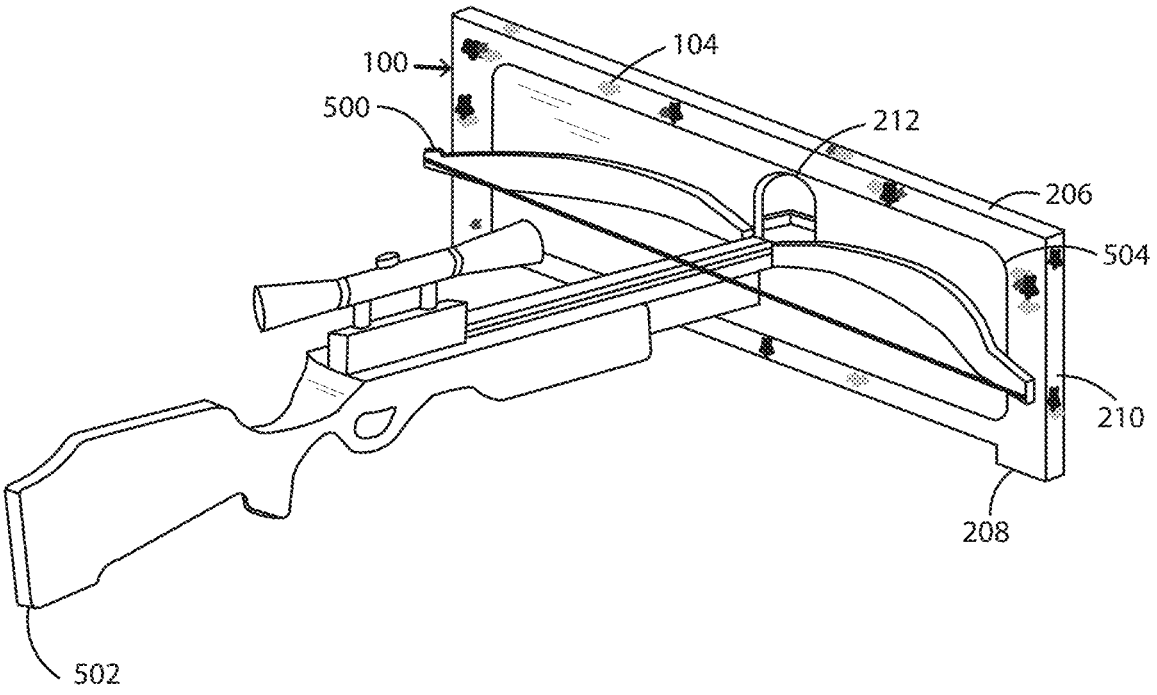
FIG. 5 is a rear right perspective view of a fourth embodiment according to the present invention in combination with a crossbow.
Figure 6:
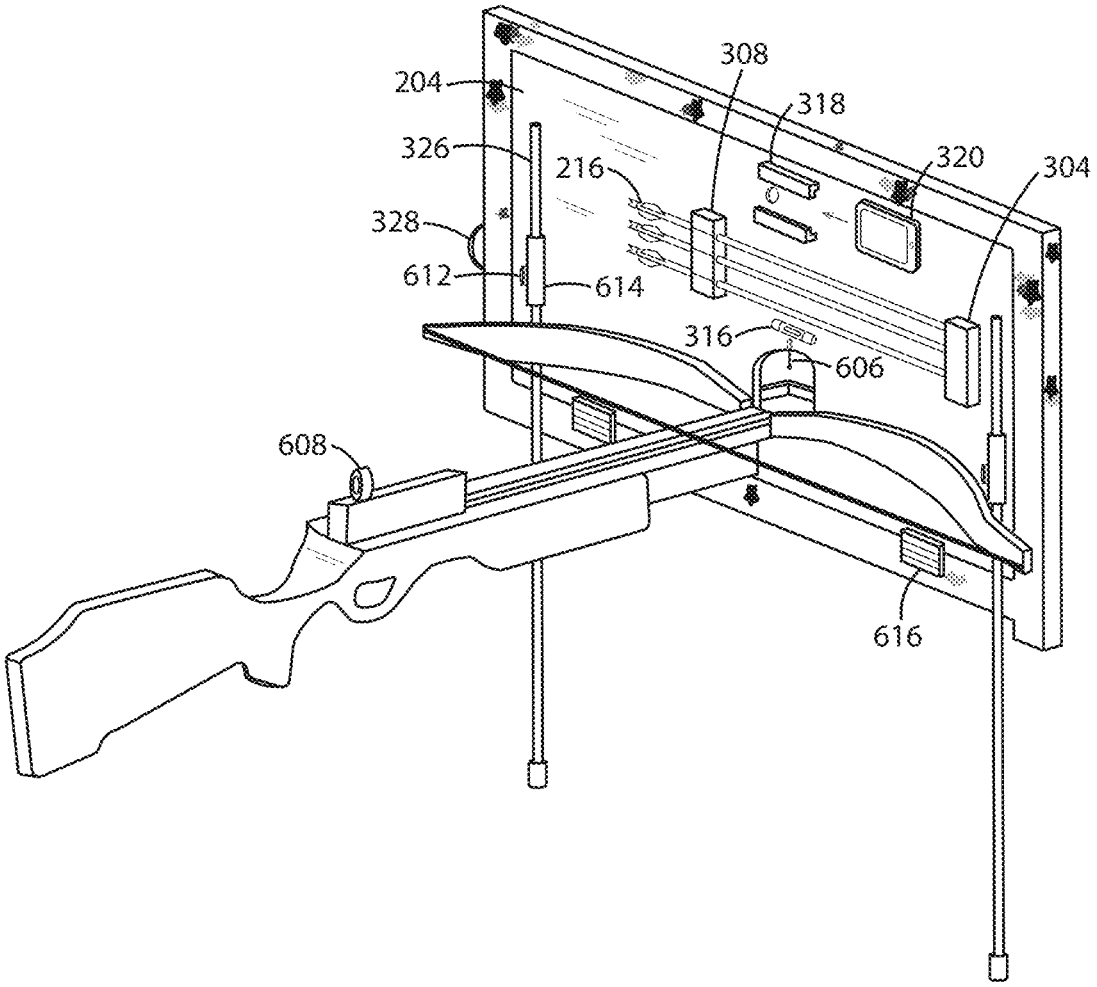
FIG. 6 is a rear right perspective view of a fifth embodiment according to the present invention in combination with a crossbow.

FIG. 5 depicts a fourth embodiment of an archery device according to the present invention. An embodiment is attached to a crossbow 500 with a mounting interface common to the crossbow accessory industry which might be of fixed, axial, or removable design (not shown). The height and width dimensions of this embodiment will be different than an embodiment for a vertical bow type, as crossbows operate in a horizontal plane and are generally much shorter than vertical bow types. The body 100 of the embodiment is constructed of materials which will absorb, diffuse, and/or deflect the noises and sound waves generated when a bolt (crossbow arrow) is shot from a crossbow 500. The dimensions of the body 100 including its thickness may be increased to provide additional sound interception for crossbows which generate more noise than an average crossbow. The sighting/shooting port(s) 212 allow aiming and unimpeded bolt travel, but will generally be minimized in size to maximize sound interception as with other embodiments. The embodiment allows a crossbow 500 to be propped in a horizontal position on a horizontal surface via contact with the lower surface 208 of the embodiment's body and the lowest portion 502 of the tiller (crossbow stock).

The body 100 of the embodiment may serve as a visual concealment device to hide an archer and the movements required to approach game, aim, and shoot a bolt. The forward planar surface (not shown) is in an ideal orientation to host a removable mirror or camouflage surface 104 and/or have a mirror or camouflage surface fixedly printed, molded, or shaped, etc. thereon during the construction process. The upper 206 and lower 208 surfaces, and opposite sides 210 of the embodiment might be similarly covered with the same or additional camouflage layers. A removable system offering a variety of camouflage patterns allows an archer to more closely match his hunting environment. These layers might be attached to the body 100 of the embodiment via latch and hook, snap button, string ties, elastic bands, or other common attachment means. The camouflage surfaces in FIG. 5-10 for example, are held in place with an elastic band perimeter 504.

An additional crossbow embodiment might include the functions of the fourth embodiment as well as functions for containing bolts (arrows), sighting, leveling, recording, shooting stabilization via a shooting stick device, and suspension. One or more protective arrow tip hood(s) 304 for bolt (arrow) tips and one or more arrow gripping/holding structure(s) 308 may contain one or more bolts (arrows) 216 on the rearward surface 204 of the embodiment. A sighting pin 606 works together with a peep-type sight 608 on the crossbow device. A bubble level device 316 allows an archer to level his bow to the earth's surface. A shelf bracket 318 or similar may host a smart phone 320 or similar camera to record video and sound. Two independent shooting sticks 326 stabilize shooting in an adjustable manner via threaded knob clamps 612 in a tubular housing 614. The shooting sticks 326 may be removed from the tubular housing 614 and stored in a shooting stick gripper 616. The tubular housings 614 might be fixed in place or rotate to a horizontal position for storage. A weather-resistant suspension loop 328 allows an archer to suspend the embodiment if desired.

Figure 9:
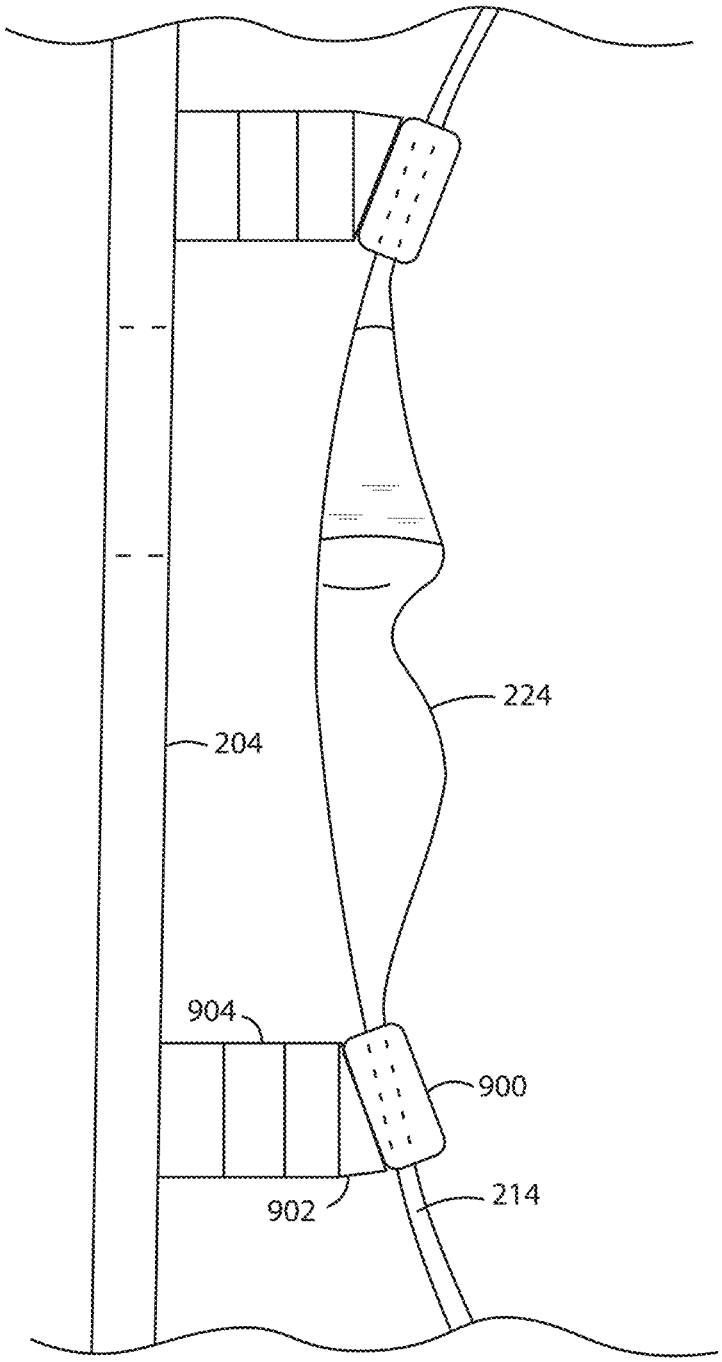
FIG. 9 is a left elevation view of a second mounting interface according to the present invention in combination with an archery bow.

A multi-function archery device might be customized to meet an individual archer's needs, as they may differ drastically from one shooting or hunting style to another. The embodiment for an archer shooting a longbow or recurve for example may appear considerably different than an embodiment for a compound bow. Most longbows and some recurves do not have lower accessory ports and mechanical sight attachment capabilities. The embodiment's mounting interface will therefore be different for these bows. FIG. 9-10 shows an alternate mounting interface which may be considered as being known in the trade. A slotted pliable foam or rubber pad 900 may be slipped over each limb tip to wedge near the bow's handle 224, and be removably or fixedly adhered to the rearward surface 204 of an embodiment. An angled spacer pad(s) 902 vertically align angled riser designs, and flat spacer pads 904 provide clearance between the embodiment and bow 214. The pads might be adhered together or attached to the embodiment with glue or by temporary means such as hook and loop (Velcro), magnet, or clamp, etc. A crossbow embodiment might also incorporate this mounting interface. Additional functions may be added to these embodiments to provide options for an archer as described in the second embodiment of FIG. 3-10, including propping, balancing, sighting, leveling, video/sound recording, shooting stabilization via a shooting stick device, and suspension.

A manufacturer may wish to consider additional options when marketing a multi-function archery device. Fixed, adjustable, foldable, and/or removable feet or legs (not shown) might assist with the propping function or with shooting stabilization, allowing a bow to be propped in a canted position, or to be propped without a lower bow part contacting the earth.

The sighting/shooting port might consist of separate ports for each function.

Several mounting interfaces common to other bow accessories in the archery trade could connect the embodiment to a vertical-type bow or crossbow.

FIG. 8A-10 depicts an axial mounting interface in a position which would place an embodiment forward of a bow's riser 315 in an operational position. The bow's string 228 reveals the front 800 and a side of a bow 214 (FIG. 2). Two screws 802 attach a bow bracket 804 to a bow's riser 315. A swing arm 806 connects the bow bracket 804 to a right-angle embodiment connector 808 via two axial pins 810. FIG. 8B-10 shows the axial mounting interface rotated to a stored position which would place the embodiment parallel to a plane formed by the bow's string 228 and riser 315. Adjustable friction at the axial pins, détente positions, or locking devices might keep an embodiment in alternately operational and stored positions.

Figure 10A:
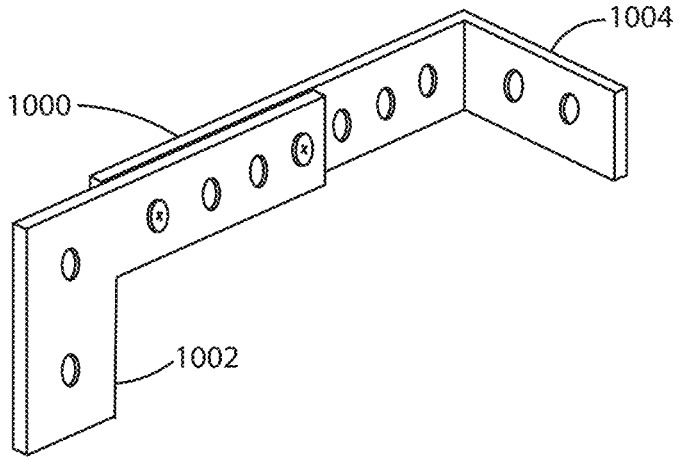
FIG. 10A is a rear right perspective view of a first fixed mounting interface according to the present invention.
Figure 10B:
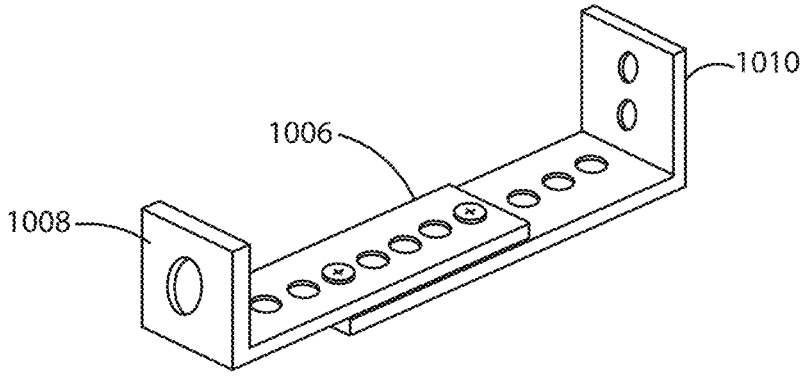
FIG. 10B is a rear right perspective view of a second fixed mounting interface according to the present invention.

A bolt-on, fixed mounting interface as seen in FIGS. 10A-10 and 10B-10 is intended to remain on a bow 214, to fix the embodiment forward of the bow 214 (FIG. 2). FIG. 10A-10 depicts an adjustable upper bracket 1000 with a proximal end 1002, for connecting at the bow's upper attachment location 218, and a distal end 1004 for connecting to the embodiment. FIG. 10B-10 depicts an adjustable lower bracket 1006 with a proximal end 1008, for connecting at the bow's lower accessory port 220 (FIG. 2), and a distal end 1010 for connecting to the embodiment.

The body of an embodiment might have a curved planar forward surface to mimic a tree's trunk and to avoid spooking game by reflecting sunlight off of a flat surface. The embodiment's rearward surface might be a flat plane for ease of accessory installment or curved, if desired. The forward, rearward and/or other surfaces might be coarsely or finely textured in a three-dimensional manner to achieve a more natural appearance.

An embodiment for a vertical-type bow may feature a body of two medial halves, split parallel to a bow's string, to be axially rotated, or removed in halves, each half to be stored on opposite sides of a bow, providing perfect bow balance in the operational and stored positions. In all embodiments, an archer should be able to shoot an arrow from the bow with the embodiment forward or when stored at the side of a bow.

A see-through, shoot-through fabric mesh layer might partially or completely cover the sighting/shooting port(s) to further conceal an archer.

The foregoing is considered as illustrative only of the principles of the invention. Furthermore, since numerous modifications and changes will readily occur to those skilled in the art, it is not desired to limit the invention to the exact construction and operation shown and described. For instance, while terms like "vertical" and "horizontal" are used throughout, the terms are intended for general reference. Though technically such terms may include precise vertical and horizontal directionality, such precision is not required to fall within the scope of the description. While the preferred embodiment has been described, the details may be changed without departing from the invention, which is defined by the claims.

I claim:

1. A device comprising:

a panel having a substantially planar forward surface and opposed substantially planar rearward surface;

a projectile portal formed through the panel;

a mounting interface configured to support the panel on an archery bow; and a camera port formed through the panel; and a camera support bracket configured to support an image capture device to enable capturing of images through the camera port.

2. A method comprising the steps of:

securing a panel to an archery bow, the panel comprising a first opening therethrough;

nocking an arrow on a string of the archery bow, the nocked arrow extending through the opening;

releasing a string of the bow to propel the arrow entirely through the opening in an aiming direction; and circumferentially about the first opening, substantially intercepting by at least one of absorbing, diffusing, and deflecting sound waves caused by the releasing step to impede travel of the sound waves in the aiming direction.

3. A method according to claim 2, further comprising the step of removing the arrow from a quiver supported by the panel prior to the nocking step.

4. A device comprising:

a panel having a substantially planar forward surface and opposed substantially planar rearward surface;

a one or more portals formed through the panel; and a mounting interface configured to support the panel on an archery bow, wherein the panel is constructed of at least one material disposed about the one or more portals to substantially intercept sound waves caused by releasing a projectile in the aiming direction by at least one of absorbing, diffusing, and deflecting the sound waves.

5. A device according to claim 4, further comprising a quiver structure secured to the rearward surface.

6. A device according to claim 5, wherein the quiver structure comprises:

at least one tip hood aligned with a clip.

7. A device according to claim 4, further comprising an extendable resting mechanism configured to longitudinally translate from a stored position to an activated position.

8. A device according to claim 7, the resting mechanism comprising:

at least one shooting stick longitudinally translatable in a direction that is at least substantially parallel to the rearward surface; and a lever, the activation of which causes the shooting stick to translate from the stored position to the activated position, the lever being spring biased in a direction to frictionally engage the shooting stick, thereby substantially impeding longitudinal translation of the shooting stick, wherein the translation of the shooting stick is caused by gravity.

9. A device according to claim 4, wherein the panel comprises a material selected from the group consisting of wood, carbon fiber, plastic, and fiberglass.

10. A device according to claim 9, wherein the panel consists essentially of the material.

11. A device according to claim 9, further comprising a textile fabric covering a majority of the panel.

12. A device comprising:

a panel having a substantially planar forward surface and opposed substantially planar rearward surface;

a projectile portal formed through the panel;

a mounting interface configured to support the panel on an archery bow; and a camera support bracket configured to support an image capture device relative to the panel.

13. A device according to claim 12, further comprising a quiver structure secured to the rearward surface.

14. A device according to claim 13, wherein the quiver structure comprises:

at least one tip hood aligned with a clip.

* * * * *